US005102309A

United States Patent [19]

Spehr

[11] Patent Number: 5,102,309

[45] Date of Patent: Apr. 7, 1992

[54] HIGH-PRESSURE RECIPROCATING PUMP

[75] Inventor: Günther Spehr, Kornwestheim, Fed. Rep. of Germany

[73] Assignee: Firma L'Orange GmbH, Fed. Rep. of Germany

[21] Appl. No.: 642,425

[22] Filed: Jan. 17, 1991

[30] Foreign Application Priority Data

Jan. 30, 1990 [DE] Fed. Rep. of Germany ..... 4002557

[51] Int. Cl.[5] ..... F04B 7/04; F04B 39/10

[52] U.S. Cl. ..... 417/490; 123/509

[58] Field of Search ..... 417/490, 494, 499; 123/495, 509, 300

[56] References Cited

U.S. PATENT DOCUMENTS

| | | | |
|---|---|---|---|
| 2,831,433 | 4/1958 | Seifert et al. | 417/494 |
| 3,438,359 | 4/1969 | Thoma | 123/300 |
| 3,885,895 | 5/1975 | Staudt et al. | 417/499 |
| 4,829,646 | 5/1989 | Cigolotti et al. | 123/495 |
| 4,897,024 | 1/1990 | Hätz et al. | 417/499 |
| 4,975,029 | 12/1990 | Hatz | 417/494 |

FOREIGN PATENT DOCUMENTS

| | | |
|---|---|---|
| 1653500 | 6/1966 | Fed. Rep. of Germany . |
| 1993796 | 5/1968 | Fed. Rep. of Germany . |
| 0360980 | 7/1938 | Italy . |
| 0465887 | 9/1951 | Italy . |
| 2077862 | 12/1981 | United Kingdom . |

*Primary Examiner*—Richard A. Bertsch
*Assistant Examiner*—Michael I. Kocharov
*Attorney, Agent, or Firm*—Evenson, Wands, Edwards, Lenahan, & McKeown

[57] ABSTRACT

A high-pressure pump with a plunger reciprocating in a cylinder has a cylindrical guide surface on the plunger chamber side of the inlet/outlet port and a cylindrical guide surface on the drive side of an axial chord of 0.05 to 0.5 times the plunger diameter. This provides an advantage in that under high pump pressure the plunger emerges from the guide surface so that the plunger surface areas exposed to unilateral side forces are reduced. This prevents the plunger from canting and possibly seizing on the cylinder wall.

10 Claims, 1 Drawing Sheet

HIGH-PRESSURE RECIPROCATING PUMP

BACKGROUND AND SUMMARY OF THE INVENTION

This invention relates to a high-pressure reciprocating pump having a cylinder, a plunger slideably guided therein, and at least one inlet/outlet port for the pumped medium, said port being intermittently blocked by the plunger, where the cylinder wall is in its drive-end area shaped to form a guide surface for the plunger and where an annular recess is provided in the plunger chamber end area, which is spaced apart from the inlet/outlet port by a first cylindrical guide surface.

A high-pressure reciprocating pump of this description has been disclosed in German patent specification 1653500 and is used as an injection pump for engines, more particularly diesel engines.

In advanced designs, the injection pressure is increasingly raised; it has reached about 1500 bar. At these elevated pressures the plunger, although given very little running clearance, may easily cant during the high-pressure phase under high lateral forces and rub against the guide. This may cause the plunger to seize on the cylinder wall.

Endeavors have previously been made to prevent such seizing. For example, German patent specification 2741348 describes a plunger into which several circumferential slots communicating with the filling chamber are recessed.

British Patent Documents GB 724 986 and GB 2 077 862 disclose high-pressure reciprocating pumps of this generic description having means for preventing the exit of pumped medium along the drive direction between the plunger and the cylinder, where the annular recess is provided to facilitate manufacture.

In a broad aspect, the present invention provides a high-pressure reciprocating pump of the above generic description for use at high pressure without the risk of seizing.

It is a particular object of the present invention to provide a reciprocating pump where on the drive side with reference to the inlet/outlet port, a second annular 0.2 to 1.0 times the plunger diameter, said recess being separated from the inlet/outlet port by a second guide surface, where the first and the second guide surfaces have an axial chord of 0.05 to 0.5 d, and where both annular recesses have a depth of 0.1 to 3 mm referred to the guide surfaces.

The present invention provides an essential advantage in that with increasing plunger travel and pump pressure, the plunger emerges form the guide surface and so reduces its surface areas exposed to the application of unilateral side forces, because the uniform increase of the emerging circumferential surface of the plunger causes the latter to be pressurized uniformly all around. This causes the unilateral side forces induced by canting to be appreciably alleviated by the newly created, circumferentially balanced side forces. The farther the travel of the plunger towards top dead center causes the plunger chamber pressure to rise, the farther the plunger emerges into the recessed area behind the guide surface to be uniformly laterally pressurized on this growing circumferential plunger surface.

If the axial chord of the guide surface ($e_1$) is made too large, more particularly larger than $0.5 \times d$, as it is the case on conventional high-pressure reciprocating pumps, the relative growth in balanced side forces is not sufficiently large to prevent rubbing or seizing also under peak pressures. If, on the other hand, $e_1$ is made too small, more particularly smaller than $0.05 \times d$, adequate sealing is no longer ensured.

A range of 0.1 to $0.3 \times d$ has shown to be an especially beneficial value of $e_1$. The exact value of $e_1$ to select will depend on the prevailing operating conditions, especially the pressures.

The annular recess on the drive side causes further surface areas to be relieved of lateral pressure, so that an important portion of the plunger surface is balanced circumferentially that might otherwise apply undesirable lateral pressure on the plunger exactly in the starting phase of pressurization. From this aspect, an axial chord of the annular slot of $n=0.2$ to $2.0 \times d$ has proved especially beneficial. Normally the distance $e_2$ is made approximately equal to $e_1$. Depending on pump design operating conditions and pressures, however, other values may be preferable.

In a further advantageous aspect of the present invention the plunger, as previously disclosed, has a circumferential slot communicating with the plunger face, where from said circumferential slot in the drive direction the plunger has a conical shape over a limited section (k). The pressure of the pumped medium incident into the conical gap advantageously initiates the parallel position of the plunger relative to the cylinder centerline. It additionally reduces the side forces acting on the plunger.

This arrangement is especially advantageous in conjunction with the annular slot described above, because when combined, these two features facilitate the centering of the plunger during the initial phase of pressure build-up. The length (k) of this conical section should be selected such that wher the position of the plunger in the guide is that prevailing at the beginning of delivery, no communication exists between the plunger chamber and the annular slot. The angle alpha with the plunger centerline amounts to 0.2' to 10' (minutes).

Other objects, advantages and novel features of the present invention will become apparent from the following detailed description of the invention when considered in conjunction with the accompanying drawings.

DETAILED DESCRIPTION OF THE DRAWINGS

Figure 2:
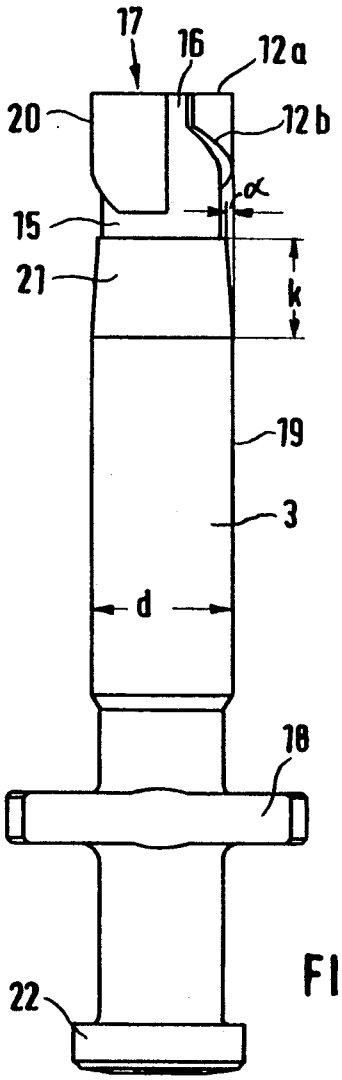
FIG. 2 is a lateral view illustrating the plunger of the high-pressure reciprocating pump.
Figure 1:
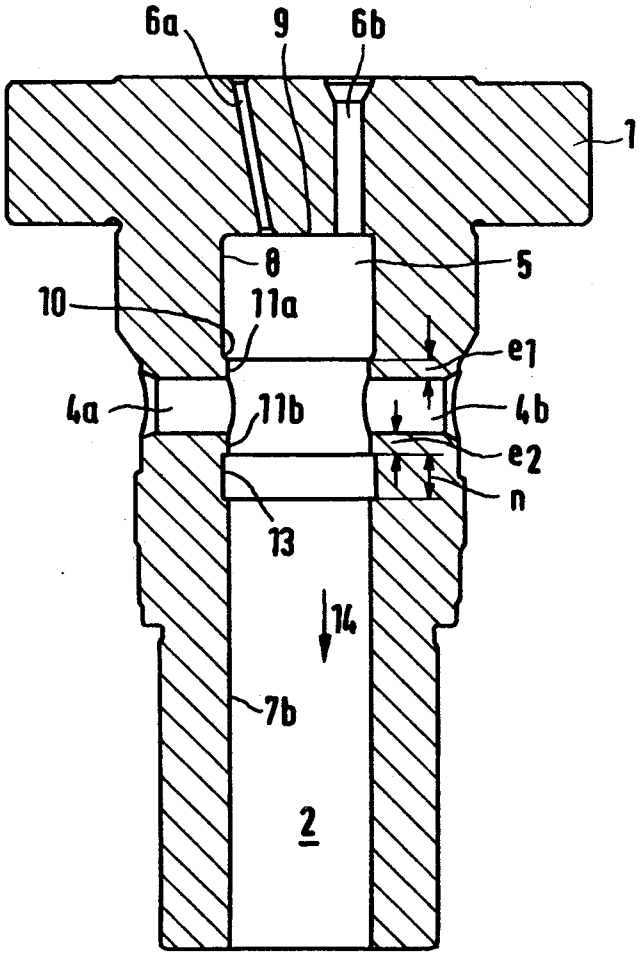
FIG. 1 is a sectional view of the cylinder of a high-pressure reciprocating pump, constructed in accordance with a preferred embodiment of the invention.

With reference now to FIG. 1, a cylinder 1 of a high-pressure reciprocating pump (not illustrated on the drawing) essentially has a central bore 2 to accommodate a plunger 3 shown in FIG. 2. The bore 2 communicates with two inlet/outlet ports 4*a*, 4*b* or, although not shown on the drawing, vertically spaced apart inlet and outlet ports, to admit and discharge the medium delivered by the pump. There may be one or several inlet and outlet ports; where they are vertically arranged, two each inlet and outlet ports should preferably be provided. The pumped medium normally is diesel oil. The extreme region of the bore 2 is shaped as a plunger chamber 5 which communicates with the discharge ducts 6*a* and 6*b*.

The cylinder wall 7 takes the shape of a guide surface and corresponds to the outside diameter of the plunger 3. In the area of plunger chamber 5 the cylinder wall 7 exhibits an annular recess 8 extending from the face wall 9 of the bore 2 to a step 10. The annular recess 8 is ground to an approximate radial depth of 0.2 mm to 1.0 mm to create sufficient pressurization of the piston 3 all around.

Figure 3:
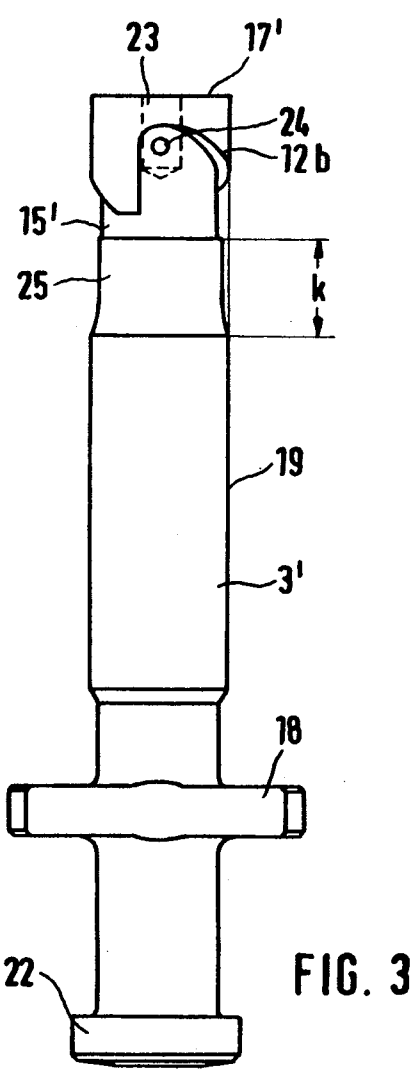
FIG. 3 is a lateral view of an alternative embodiment of a plunger of the high-pressure reciprocating pump.

Between the edges of the inlet/outlet ports 4*a*, 4*b* towards the plunger chamber and said step 10, a cylindrical guide surface 11*a* is provided, the axial chord or length $e_1$ of which is defined as a function of the plunger diameter d illustrated in FIG. 3.

In a direction pointing to the drive end a second guide face 11*b* is provided at a distance from the inlet/-outlet ports 4*a*, 4*b* which is limited in the direction of the drive end 14 by an annular recess 13. The length of this second guide surface $e_2$ is preferably made equal to $e_1$. The annular slot 13 has an axial chord or length n behind which the cylinder wall 7 is again designed to guide the plunger 3.

The annular recess is preferably ground to a radial depth of 0.2 mm to 1.0 mm to provide sufficient volume for pressure balancing. The cylindrical guide surfaces can be coated with a known coating material to alleviate abrasive wear.

FIG. 2 is a lateral view illustrating a plunger 3. The plunger essentially exhibits a circumferential slot communicating with the face 17 of the plunger 3 through a longitudinally extending slot 16. Helixes 12*a,b* are provided to control the beginning and end of delivery.

At its drive end the plunger 3 has a base 22 operationally pressurized by a cam omitted on the drawing, and a plunger vane 18 to rotate the plunger 3 circumferentially.

The plunger 3 is provided with a rear guide section 19 and a forward guide section 20 to cooperate with the cylinder wall 7, more particularly with the guide surfaces 11*a* and 11*b*, to achieve cant-free sealing reciprocating motion.

The plunger 3 also exhibits a conical section 21 chamfered at an angle alpha in the direction of the control slot.

FIG. 3 illustrates an alternative embodiment of the plunger 3' which essentially conforms to that of the plunger 3 in FIG. 2, except that in lieu of a longitudinal slot, a centrally arranged blind hole 23 is drilled into the plunger face 17. Said blind hole 23 communicates with the circumferential slot 15' through a transverse drilled hole 24, said slot 15' having a helix 12*b* to control the end of injection similarly to the arrangement of plunger 3.

The plunger 3' is also provided with a ground section 25 which in shape and function corresponds to the conical section 21 of FIG. 2.

The conical section 21 and the ground section 25 both serve to centrally position the plunger 3 or 3' in the early stage of pressure build-up. For this purpose, these sections are designed to form a liquid wedge contributing towards fast pressurization all around when the plunger moves towards upper dead center. The annular recess 8 of FIG. 1 is ground to an approximate depth of 0.1 to 3 mm relative to the guide surface 11*a* on the pressure side, depending on plunger diameter d. In this arrangement the depth of the annular recess 8 is selected in the interest of a sufficiently sized gap between the plunger 3 or 3' immersing into the plunger chamber 5 and the cylinder wall 7, permitting the fluid pressure prevailing in the plunger chamber 5 to act laterally through this gap on the circumferential surface of the piston 3, especially on its forward guide section 20. If this annular recess 8 is not ground sufficiently deep, the inventive effect is not achieved, because the side force acting on the plunger is reduced and with it the centering action.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A high-pressure reciprocating pump having a cylinder, a plunger axially slideably guided therein, and at least one inlet/outlet port for the pumped medium, said port being intermittently blocked by the plunger, wherein the cylinder wall has a drive-end area shaped to form a guide surface for the plunger and an annular recess is provided in a plunger chamber end area thereof, which is spaced apart from the inlet/outlet port by a first cylindrical guide surface, wherein on a drive side with reference to the inlet/-outlet port, a second annular recess is provided in the cylinder wall of an axial chord 0.2 to 1.0 times the plunger diameter, said second annual recess being separated from the inlet/out port by a second guide surface, wherein the first and the second guide surfaces have an axial chord of 0.05 to 0.5 the plunger diameter, and wherein both annular recesses have a depth of 0.1 to 3 mm with reference to the guide surfaces.

2. High-pressure reciprocating pump of claim 1, wherein the axial chord of the first cylindrical guide surface is between 0.1 and 0.3 times the plunger diameter.

3. High-pressure plunger of claim 1, wherein the cylindrical guide surfaces are coated to alleviate abrasive wear.

4. Device of claim 1, wherein the plunger has a face and a circumferential slot communicating with the plunger face, and wherein the plunger exhibits a conical shape in a limited axial section extending towards the drive side from the circumferential slot.

5. Device of claim 4, wherein a angle alpha of the conical plunger section ranges from 0.2 to 10 minutes of arc.

6. Device of claim 5, wherein the angle alpha ranges from 1 to 3 minutes of arc.

7. Device of claim 2, wherein the plunger has a face and a circumferential slot communicating with the plunger face, and wherein the plunger exhibits a conical shape in a limited axial section extending towards the drive side from the circumferential slot.

8. Device of claim 7, wherein the angle alpha of the conical plunger section ranges from 0.2 to 10 minutes of arc.

9. Device of claim 8, wherein the angle alpha ranges from 1 to 3 minutes of arc.

10. Device of claim 9, wherein the cylindrical guide surfaces are coated to alleviate abrasive wear.

* * * * *